US005191984A

United States Patent [19]

Kon et al.

[11] Patent Number: 5,191,984

[45] Date of Patent: Mar. 9, 1993

[54] DISPLAY OR STORAGE RACK FOR NECKTIES AND THE LIKE

[75] Inventors: Richard H. Kon, Avon, Conn.; Stephen J. Jasperson, Riverside; Torsti T. T. Jerila, West Covina, both of Calif.

[73] Assignee: The Stanley Works, New Britain, Conn.

[21] Appl. No.: 867,886

[22] Filed: Apr. 13, 1992

[51] Int. Cl.[5] ..... A47F 5/00

[52] U.S. Cl. ..... 211/115; 211/94; 211/95

[58] Field of Search ..... 211/115, 94, 95, 168, 211/162, 163

[56] References Cited

U.S. PATENT DOCUMENTS

| | | | |
|---|---|---|---|
| 850,363 | 4/1907 | Frankel | 211/94 |
| 2,010,572 | 8/1935 | Waterman | 211/95 |
| 2,033,430 | 3/1936 | Kirk | 211/95 |
| 2,451,110 | 10/1948 | Newman | 211/115 X |
| 3,160,279 | 12/1964 | Hovey | 211/94 X |
| 3,339,744 | 9/1967 | Ginsberg | 211/115 X |
| 4,869,379 | 9/1989 | Hawkrige | 211/94 X |

FOREIGN PATENT DOCUMENTS

| | | | |
|---|---|---|---|
| 757245 | 9/1956 | United Kingdom | 211/95 |

*Primary Examiner*—Robert W. Gibson, Jr.
*Attorney, Agent, or Firm*—Christie, Parker & Hale

[57] ABSTRACT

A necktie storage rack has an elongated U-shaped hosuing mounted horizontally. An elongated slide with an external shape complementary to the inside of the housing can slide longitudinally in the housing from a retracted position essentially completely within the housing to an extended position with about half of the slide extending forwardly from the housing. Three posts extend downwardly from the slide and a wheel is rotatably mounted on each of the posts. The wheels are designed to elastically snap onto the posts. A number of radially extending legs on the wheel are used for hanging neckties. The entire assembly can be fabricated of injection molded plastic and connected together without any fasteners except screws for supporting the tie rack in a closet. The back of the housing can be secured to a wall and a forward portion of the housing suspended from a closet hanger bar by a pair of side-by-side clamps fastened together by a single screw.

18 Claims, 5 Drawing Sheets

10
12
14
18
19
23
18
11
14
17
16
17
26
28
24
27
21
23

DISPLAY OR STORAGE RACK FOR NECKTIES AND THE LIKE

BACKGROUND

This application concerns a retractable or extendable rack on which neckties may be displayed or stored. It is particularly suitable for use with a modular shelving and hanger bar system as described and illustrated in U.S. Pat. No. 4,995,323.

Most householders will recognize that the storage of neckties can be troublesome. One cannot simply dump them in a drawer and keep them presentable. One can also simply hang neckties over a coat hanger, but a hanger tends to tilt so that all of the ties slide to one end. They should hang from some kind of a rack. A number of storage racks have been proposed over the years, many of which are effectively like a roll of nails in the wall. In some of these the "nails" on which the ties are hung may pivot between a position perpendicular to the wall and one more parallel to the wall. Other racks have a bar with one end pivoted to the wall and a row of hooks along the bar for holding neckties. Ties may be stored on a wheel with radiating hooks. Other arrangements have probably been proposed and, as far as known, all of them have certain shortcomings.

It would be desirable to have neckties stored in a rack between the clothes hanging on a closet hanger bar. A problem with that, however, is that the ties would be obscured by the clothes hanging on either side of the rack. Thus, it is desirable to provide a rack that can be mounted perpendicular to the hanger bar in the closet and be extended for selecting or restoring a tie and retracted during storage.

BRIEF SUMMARY OF THE INVENTION

There is, therefore, provided in practice of this invention according to a presently preferred embodiment, a storage rack comprising an elongated housing with a generally U-shaped transverse cross-section and means for mounting the housing horizontally with the mouth of the U facing downwardly. An exemplary mounting includes clamps for engaging the hanger bar in a closet. An elongated slide fits within the housing so as to slide longitudinally between a retracted position with the slide essentially completely within the housing and an extended position with the slide extending longitudinally from the housing about half of its length. A plurality of posts extend downwardly from the slide and a wheel is rotatably secured on each of the posts. Each wheel includes a plurality of radially extending legs for supporting ties.

BRIEF DESCRIPTION OF THE DRAWINGS

These and other features and advantages of the invention will be appreciated as the same becomes better understood by reference to the following detailed description when considered in connection with the accompanying drawings wherein.

DETAILED DESCRIPTION

Figure 1:
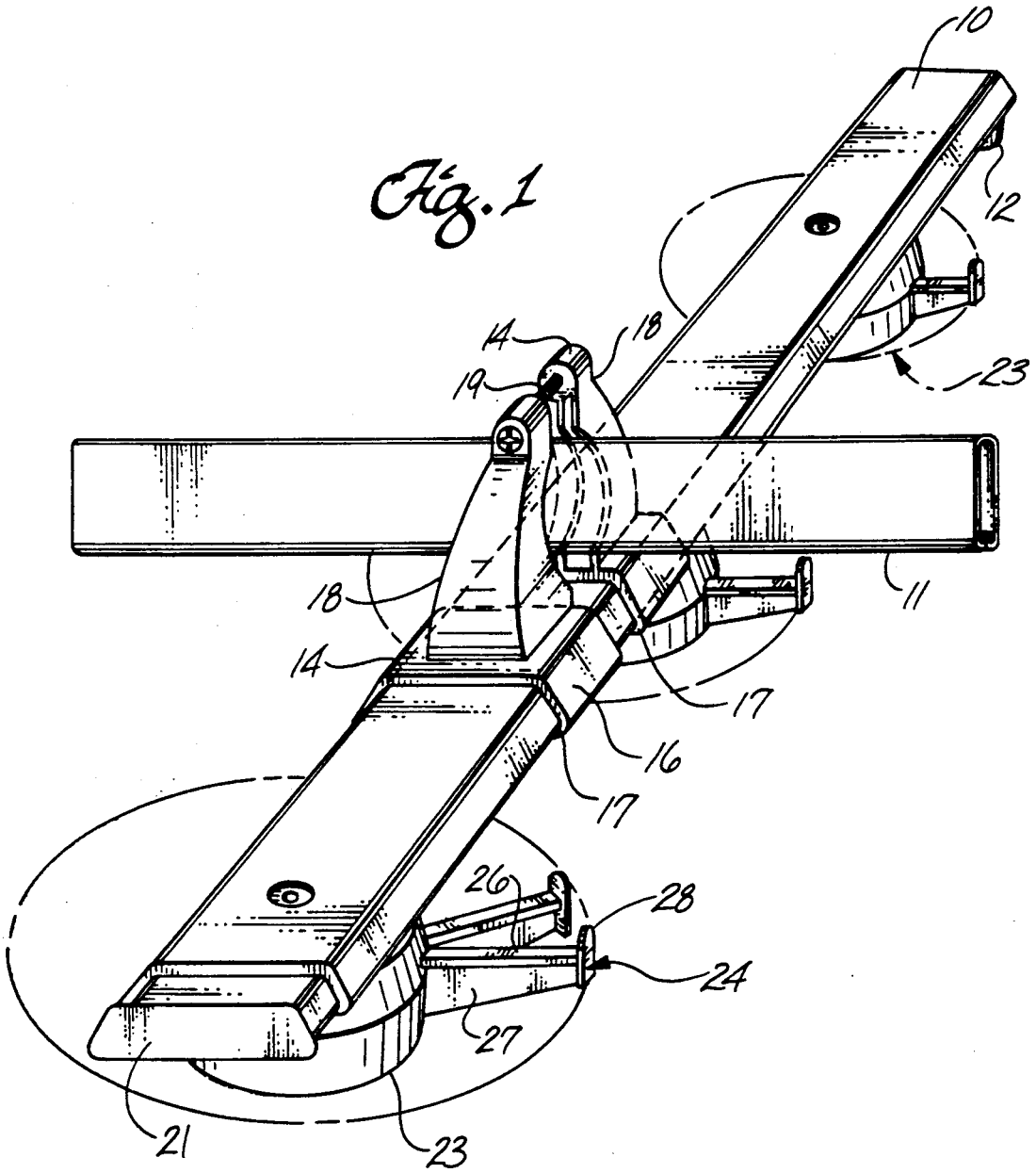
FIG. 1 illustrates a perspective sketch of a tie storage rack constructed according to principles of this invention.

The tie storage rack has an elongated horizontal housing 10 which is suspended beneath a conventional hanger bar 11 in a closet. A vertical tab 12 at the back end of the housing has a screw hole 13 so that the housing can be fastened to the back wall of a closet or the like. The housing is suspended beneath the hanger bar by a pair of side-by-side clamps 14 which are substantially identical.

Each of the clamps has a base 16 with a U-shaped passage substantially complementary to the outside of the trapezoidal transverse cross-section of the housing. At the bottom of each edge of the base there is a short inwardly directed lip 17 which fits under the edge of the housing to support the housing. The two clamps are mounted on the housing by sliding along its length from the forward end of the housing.

Each clamp has a somewhat curved hook portion 18 extending upwardly from the base. Each hook has a recessed face opposite the other clamp for fitting around and engaging the hanger bar. The recessed faces have a generous curve for accomodating connection around an oval hanger bar as illustrated, a round hanger bar as often used in closets, or other shapes which may sometimes be found. Each of the hooks is hollow and suitably stiffened with a rib 15 for ease of injection molding. The hooks and other parts of the hanger bar are preferably injection molded from polypropylene or the like.

A machine screw 19 interconnects the two clamps at the top. As mentioned, the clamps are substantially identical. They differ in that the front clamp has a clearance hole 20 at the top for passage of the machine screw and the rear clamp has a similar clearance hole and a hexagonal recess at the back. The machine screw is threaded into a hexagonal nut pressed into the hexagonal recess. Alternatively, the rear clamp may have a hole with a smaller diameter than the clearance hole in the front clamp for receiving a self tapping screw for fastening the clamps together at the top.

A slide 21 fits into the housing and has a length approximately the same as the length of the housing. As will be apparent from structure described hereinafter, the slide is mounted for moving between a retracted position where is it essentially completely within the housing and an extended position where approximately half of the length of the slide extends forwardly from the housing. In FIG. 1 the slide is illustrated slightly withdrawn from the retracted position toward the extended position.

Figure 4:
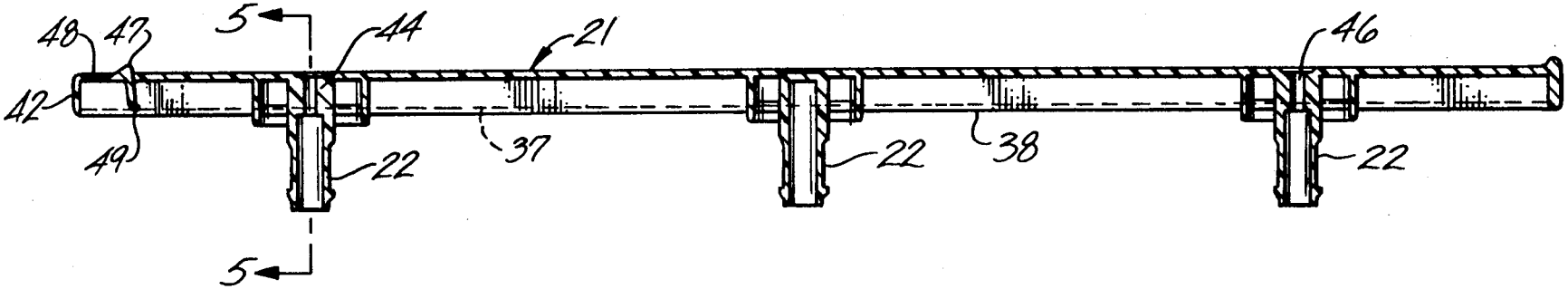
FIG. 4 is a longitudinal cross-section of the slide that fits within the housing.

Three posts 22 (FIGS. 4 to 6) extend downwardly from the slide. A wheel 23 is mounted on each of the posts. In an exemplary embodiment eighteen legs 24 extend radially on each wheel. Each leg has a slightly T-shaped cross-section with a crossbar 26 along the top, and a somewhat thinner web 27 extending downwardly. A raised foot 28 at the end of each leg keeps a necktie hanging over the crossbar of such a leg from sliding off the end.

Figure 2:
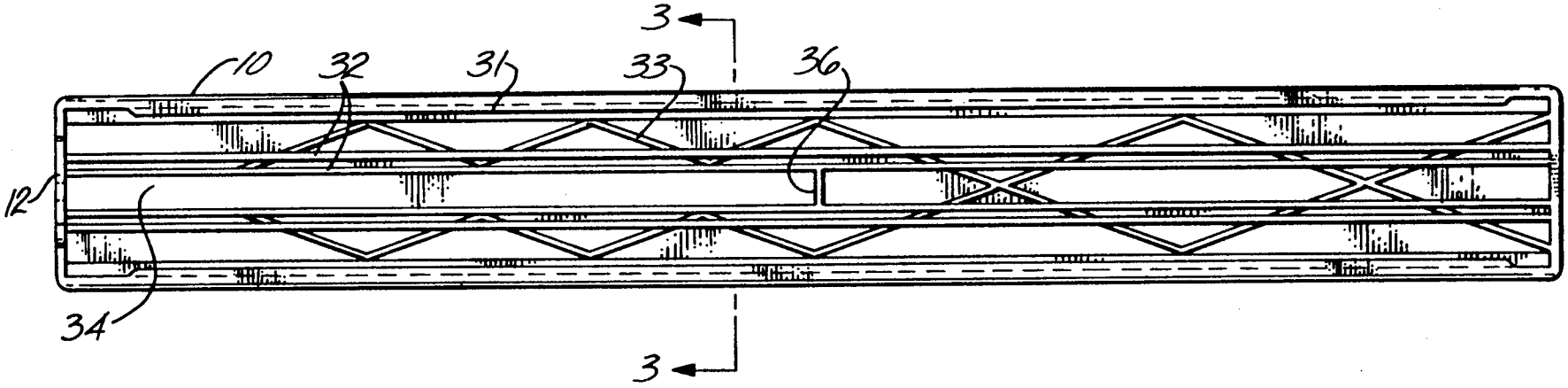
FIG. 2 is a bottom view of the housing of the storage rack with the slide removed.
Figure 3:
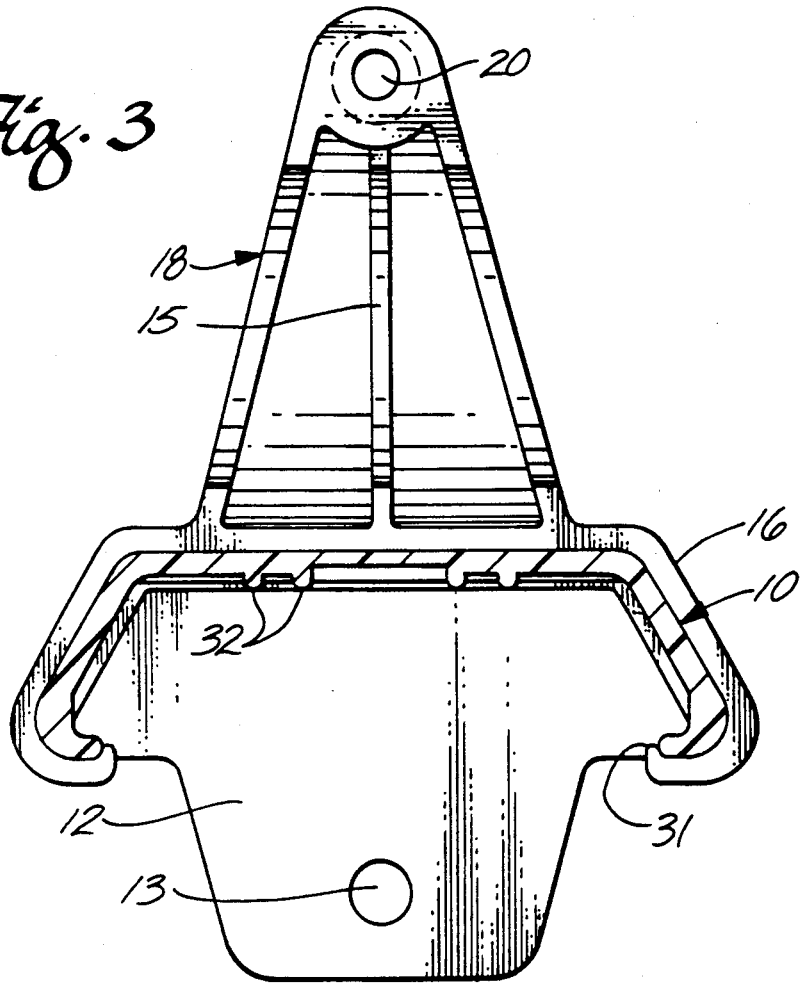
FIG. 3 is an exemplary transverse cross-section of the housing, with a supporting clamp in place.

As can be seen more clearly in FIGS. 2 and 3 the housing has a generally U-shaped transverse cross-section with the mouth of the U facing downwardly. At each side of the mouth of the U there is an inwardly directed lip 31 which supports the slide within the housing. Inside the housing there are four small longitudinally extending stiffening ribs 32. In addition, there are diagonally extending cross ribs 33 which enhance the torsional stiffness of the housing. Toward the forward end (at the right in FIG. 2) of the housing, the cross ribs extend essentially the full width of the housing. In the rear portion the cross ribs extend from near the outside edges of the housing only as far as the inner pair of longitudinal stiffening ribs 32.

In this rear portion of the housing the wall thickness of the housing between the inner pair of longitudinal ribs is thinner than the balance of the top wall of the housing. For example, the principal portion of the top wall may have a thickness of 2.16 mm., and the wall thickness in the channel 34 between the ribs may be only 1.4 mm. At the forward end of the channel there is a shoulder 36 about 2 mm. high.

Figure 5:
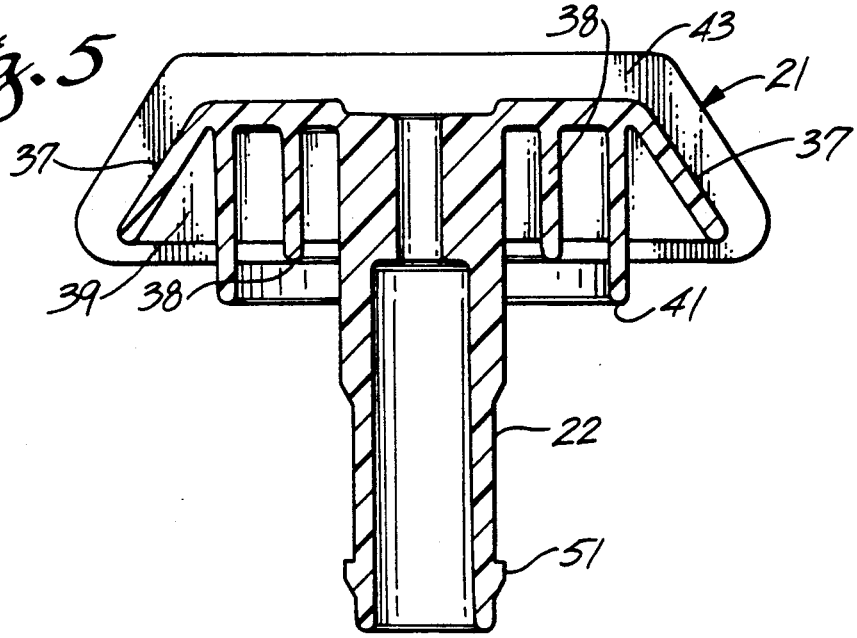
FIG. 5 is a transverse cross-section at one of three posts extending downwardly from the slide.
Figure 6:
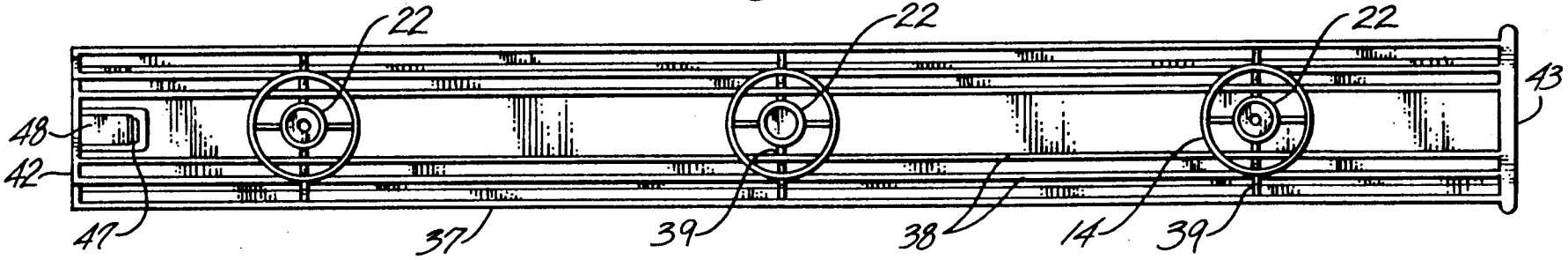
FIG. 6 is a bottom view of the slide.
Figure 7:
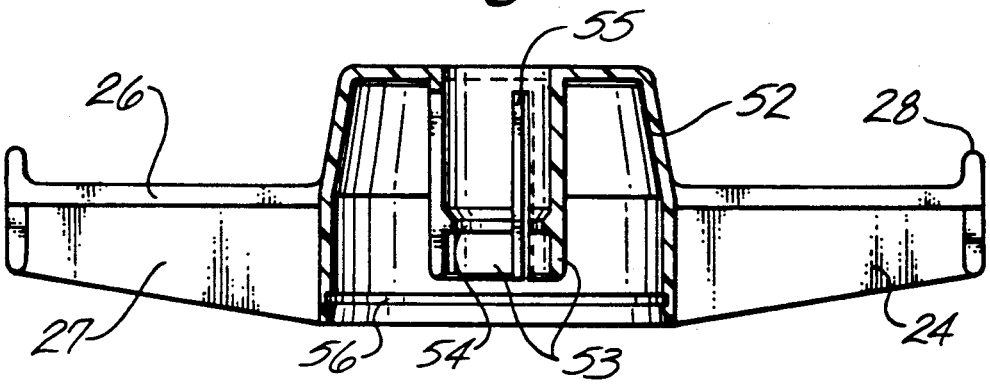
FIG. 7 is a transverse cross-section of a tie supporting wheel to fit on a post extending downwardly from the slide.
Figure 8:
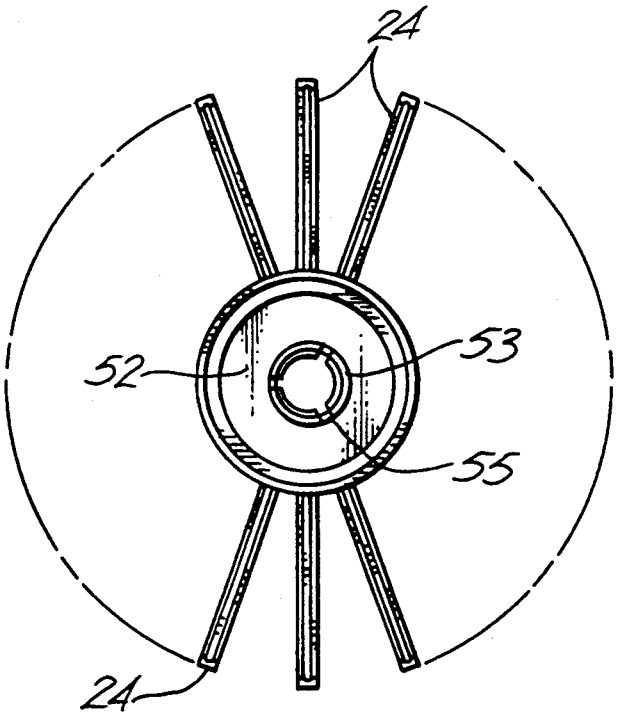
FIG. 8 is a bottom view of the wheel.

As can be seen by comparing FIGS. 3 and 5, the outside of the transverse trapezoidal cross-section of the slide is complementary to the inside of the U-shaped cross-section of the housing. In detail, the transverse cross-section of the slide has a pair of downwardly extending diverging flanges 37 at each side. The lower ends of the flanges ride on the inwardly extending lips 31 inside the mouth of the housing. In between the flanges there are four longitudinally extending stiffening ribs 38. Adjacent to each of the posts 22 there is a transversely extending stiffening rib 39 between the post and the outside flange. Surrounding each of the posts is a downwardly extending hollow cylindrical escutcheon 41.

At the rear of the slide there is a plate 42 interconnecting the flanges and longitudinal ribs. At the forward end the flanges and ribs connect to an enlarged face plate 43 which also serves as a finger grip for extending or retracting the slide in the housing. The enlarged face plate limits the retraction of the slide into the housing. Collectively these features produce a very rigid slide with a minimum amount of material.

Each of the three posts 22 is hollow. The depth of the hollow portion of the two end posts is somewhat less than the depth of the hollow center post, leaving a thick boss 44 near the top face of the slide. A hole 46 through each boss is available for receiving a self-tapping screw. This arrangement with a boss and screw is employed in the event the user desires a different mounting arrangement for the tie rack.

In such an embodiment the housing is dispensed with. A pair of L-shaped brackets (not shown) are secured to a wall. A self-tapping screw is then passed downwardly through each L-shaped bracket into the holes in the respective bosses for supporting the tie rack with the length of the "slide" parallel to the wall. This feature enhances the versatility of the tie rack and indicates the desirability of providing a principal portion of the stiffness of the tie rack in the slide instead of the housing.

Near the rear end of the slide there is an upwardly extending tang 47. The tang has a shallow ramp surface facing the rearward end of the slide and a steep stop surface facing the forward end of the slide. The tang is at the end of an elastically flexible member 48 connected at its other end to the back plate 42 of the slide. A finger 49 extends downwardly from the tang.

When the slide is inserted into the housing (from the right end in FIG. 2) the tang is deflected by the shoulder 36 in the housing because of the ramp surface facing the rear of the slide. After passing the shoulder in the housing the tang snaps back into the channel 34 between the longitudinal ribs 32. When the slide is again pulled forward towards its extended position, the steep stop surface on the tang engages the shoulder at the end of the channel and prevents the slide from moving further.

The shoulder is located at about the middle of the housing so that when the slide is in its extended position with the tang against the shoulder, about half of the slide remains in the housing and about half of the slide is cantilevered beyond the forward end of the housing. If one wishes to remove the slide completely from the housing it is a simple matter to press on the finger 49 and deflect the tang so that it can pass the shoulder 36.

Each of the posts extending downwardly from the slide has a circumferentially extending flange 51 on its external surface near the bottom. Each of the flanges has an outwardly sloping surface at the bottom and a horizontal surface at the top. Well above the top of the flange, the outside diameter of the post is enlarged.

The three wheels mounted on the post are identical. Each wheel has a hub, the upper portion of which tapers inwardly. The smaller diameter upper portion of the hub fits into the cylindrical escutcheon surrounding the posts to give the rack a finished appearance. The legs 24 on which ties are hung extend radially outwardly from the lower portion of the hub.

Three fingers 53 extend downwardly from the center of the top of the hub. Each finger extends approximately 120° and is separated from the adjacent by a narrow vertical slot 55. An inwardly directed ledge 54 extends circumferentially inside each of the fingers. Each ledge has an inwardly sloping surface at the top, and a horizontal surface at the bottom. Thus, when a wheel is pushed upwardly onto a post the complementary sloping surfaces on the ledge and flange on the post deflect the finger elastically outwardly, permitting entry of the post through the hub. The horizontal surfaces on the ledges and flange prevent the wheel from coming off of the post when the fingers snap back to their original position. The upper portion of the passage through the hub engages the enlarged portion of the post for steadying the wheel as it rotates on the post. A shallow groove 56 inside the bottom of the hub can receive an optional circular cover plate (not shown) for hiding the inside of the wheel.

Although but one embodiment have a tie rack constructed according to principles of this invention has been described and illustrated herein it will be appreciated by those skilled in the art that there are many possible modifications and variations. Just for one example, the arrangement for snapping a wheel onto a post can essentially be inverted so that the fingers extend upwardly for engaging a flange on the post nearer the top. Alternatively, the hub can have a rigid passage and the post may have elastically deflectable fingers for permitting the wheel to be elastically snapped onto the post. Many other modifications and variations will be apparent to those skilled in the art, and it is therefore to be understood that within the scope of the appended claims the invention may be practiced otherwise than as specifically described.

What is claimed is:

1. A necktie storage rack comprising:
an elongated housing;
means for mounting the housing horizontally in a closet;
an elongated slide having a transverse external cross-section complementary to the internal cross-section of the housing for support within the housing with freedom to slide in the longitudinal direction between a retracted position within the housing and an extended position extending forwardly from the housing;
a plurality of wheels rotatably mounted beneath the slide, each wheel including a plurality of radially extending legs having a horizontal top surface; and
means on the outer end of each leg for retaining a stored necktie on the leg.

2. A storage rack as recited in claim 1 wherein the means for mounting the housing comprises:
a pair of side-by-side essentially identical clamps, each clamp comprising:
a base portion having a passage complementary to the external cross-section of the housing, and
a hook portion extending upwardly from the base, the hook portion on each clamp opposing the hook portion on the adjacent clamp for encompassing a closet hanger bar; and
means for interconnecting the top of the two hook portions.

3. A storage rack as recited in claim 1 wherein the internal cross-section of the housing is trapezoidal and the external cross-section of the slide is trapezoidal.

4. A storage rack as recited in claim 1 further comprising:
a shoulder in the housing; and
a tang on the slide for engaging the shoulder and preventing withdrawal of the slide from the housing more than about half the length of the slide.

5. A storage rack as recited in claim 4 comprising means for elastically supporting the tang for deflection by the shoulder when the slide is first inserted into the housing.

6. A storage rack as recited in claim 5 comprising a finger connected to the tang for elastically deflecting the tang for removal of the slide from the housing.

7. A storage rack as recited in claim 1 wherein each wheel is connected to the slide by:
a post on the slide;
an axial passage in the wheel; and
means for elastically snapping the wheel onto the post and retaining the wheel on the post.

8. A storage rack as recited in claim 7 wherein the means for elastically snapping comprises:
a plurality of elastically deflectable fingers;
a flange on the post; and
a ledge on the wheel for mating with the flange for elastically deflecting the fingers upon insertion of the post into the wheel, the flange and ledge each including a horizontal surface for retaining the wheel on the post.

9. A storage rack as recited in claim 7 wherein such a post includes a boss at an upper end, and a screw hole for supporting the slide when outside of the housing.

10. A storage rack comprising:
an elongated housing having a generally U-shaped transverse internal cross-section and inwardly directed lips at the mouth of the U;
means for mounting the housing horizontally with the mouth of the U facing downwardly;
an elongated slide having a transverse external cross-section complementary to the U-shaped cross-section of the housing with a portion having a width greater than the distance between the lips for support within the housing with freedom to slide in the longitudinal direction;
a plurality of posts extending downwardly from the slide; and
a wheel rotatably mounted on each of the posts, each wheel including a plurality of radially extending legs, each leg having means on the outer end of the leg for retaining a stored article on the leg.

11. A storage rack as recited in claim 10 further comprising means for limiting the extent of longitudinal sliding of the slide in the housing between a retracted position with the slide essentially completely within the housing and an extended position with the slide extending longitudinally from the housing approximately half of the length of the slide.

12. A storage rack as recited in claim 11 wherein the means for limiting the extent of longitudinal sliding comprises:
a shoulder inside the U-shaped cross-section of the housing;
a tang on the slide for engaging the shoulder, the tang having a shallow ramp surface facing the rearward end of the slide for traversing the shoulder and a steep stop surface facing the forward end of the slide for engaging the shoulder; and
an elastically flexible member supporting the tang for deflecting as the tang traverses the shoulder.

13. A storage rack as recited in claim 12 further comprising a finger connected to the tang for elastically deflecting the member for permitting the steep stop surface on the tang to pass the shoulder.

14. A storage rack as recited in claim 10 wherein each of the wheels comprises an axial passage for fitting on a respective post; and further comprising:
a plurality of elastically deflectable fingers interconnecting the post and passage, each finger including a ledge for retaining the wheel on the post.

15. A storage rack as recited in claim 10 wherein
each of the posts includes a circumferentially extending flange;
each of the wheels comprises an axial passage for fitting on a respective post; and
each passage is formed by a plurality of elastically deflectable fingers, each finger including an inwardly directed ledge for engaging the flange and retaining the wheel on the post.

16. A storage rack as recited in claim 15 wherein each flange comprises an outwardly sloping surface at the bottom and a horizontal surface at the top and each ledge comprises an inwardly sloping surface at the top and a horizontal surface at the bottom for permitting entry of the post between the fingers and preventing removal of the post from between the fingers.

17. A storage rack as recited in claim 10 further comprising an escutcheon around each post for receiving an upper portion of the wheel.

18. A storage rack as recited in claim 10 wherein the means for mounting the housing comprises:
a pair of side-by-side clamps, each clamp comprising:
a base having a generally U-shaped passage at the bottom complementary to the outside of the housing for sliding along the length of the housing,
a hook extending upwardly from the base, each hook having a recessed face opposite the other clamp for engaging a horizontal bar; and
means for interconnecting the clamps at the top.

* * * * *